US006296577B1

(12) United States Patent
Trammell et al.

(10) Patent No.: US 6,296,577 B1
(45) Date of Patent: Oct. 2, 2001

(54) METHOD OF PUTTING A GOLF BALL

(76) Inventors: James Trammell, P.O. Box 2360; Louie Keener, 824 N. Spring, both of Harrison, AR (US) 72602

( * ) Notice: Subject to any disclaimer, the term of this patent is extended or adjusted under 35 U.S.C. 154(b) by 0 days.

(21) Appl. No.: 09/333,302

(22) Filed: Jun. 15, 1999

Related U.S. Application Data

(60) Provisional application No. 60/091,116, filed on Jun. 29, 1998.

(51) Int. Cl.[7] ..... A63B 53/04; A63B 53/06; A63B 53/08

(52) U.S. Cl. ..... 473/340; 473/277; 473/293; 473/294; 473/409

(58) Field of Search ..... 473/294, 219, 473/257, 276, 277, 300, 293

(56) References Cited

U.S. PATENT DOCUMENTS

| | | | | |
|---|---|---|---|---|
| 4,605,228 | | 8/1986 | Guendling, Jr. . | |
| 5,616,089 | | 4/1997 | Miller . | |
| 5,913,738 | * | 6/1999 | Carlucci | 473/409 |

* cited by examiner

*Primary Examiner*—Jeanette Chapman
*Assistant Examiner*—Sneh Varma
(74) *Attorney, Agent, or Firm*—Tipton L. Randall

(57) ABSTRACT

A method of putting a golf ball with a longer putting club is disclosed. The putter is of sufficient length that a player can hold the putter handle against the player's sternum and putt the golf ball positioned at the player's feet. The player maintains his wrists in a constant orientation relative to the putter handle during the putting stroke. The stroke is carried out by the player pivoting his shoulders first in one direction and then in an opposite direction to strike the golf ball with the putter head in a controlled manner to propel the ball toward a target.

10 Claims, 14 Drawing Sheets

METHOD OF PUTTING A GOLF BALL

CROSS REFERENCE TO RELATED APPLICATION

This application claims the benefit under 35 U.S.C. §119 (e) of co-pending provisional application Ser. No. 60/091,116, filed Jun. 29, 1998. Application Ser. No. 60/091,116 is hereby incorporated by reference.

FIELD OF THE INVENTION

The invention relates to a method of putting a golf ball, and more particularly, to a method employing a unique putting club for putting a golf ball.

BACKGROUND OF THE INVENTION

Golf is an popular sport that originated in Scotland over a century ago. The general rules of the game are well known and golf is a popular recreational sport for large numbers of people of all ages. The objective is to strike a golf ball from a starting point, called the "tee", such that the ball falls into a hole in the ground termed the "cup". The cup is located on a specially maintained portion of turf that is called the "green". Variously designed golf clubs are used to strike the golf ball from the starting point to the cup. Once the golf ball is on the green, a special golf club called a "putter" is used to propel the ball to the cup. Putting, as play on the green is termed, requires skill and dexterity by the player. The putter has traditionally been the shortest of the golf clubs used by the player. The player bends over the golf ball on the green and, grasping the putter with both hands, strikes or putts the ball toward the cup. Many methods of gripping the putter have been developed to promote consistency and better control of the putter.

Recently a much longer putting club has been employed by players. This club is of a length that the player holds the handle end at neck level, just under the player's chin, with one hand and further down the handle with the other hand. The player moves this long putter in a pendulum motion with the club handle end under the chin as the fulcrum point. Again, skill and dexterity are required to produce consistency with this long putter.

Thus, a need exists for a putting club and a method of using that putting club which will provide the player with consistent putting of a golf ball on a green.

SUMMARY OF THE INVENTION

The invention is a method of putting a golf ball comprising the selection of a putting club having a club head member, a shaft member, and a handle member positioned opposite the club head member, with the putting club sized to enable a player standing on a playing surface to strike a golf ball adjacent the player's feet with the club head member, while holding the end of the putting club handle member in position against the player's sternum. The player grasps the putting club handle member with both hands and holds the end of the putting club handle member against the player's sternum. The player then pivots the player's upper body in one direction with the end of the putting club handle member positioned against the player's sternum, while holding the player's wrists in a constant orientation relative to the putting club handle member, to move the club head member away from the golf ball positioned adjacent to the player's feet. The player next pivots the player's upper body in an opposite direction with the end of the putting club handle member positioned against the player's sternum, while holding the player's wrists in a constant orientation relative to the putting club handle member to move the club head member toward the golf ball positioned adjacent to the player's feet, thereby striking the golf ball with the putting club head member in a controlled manner to propel the ball toward a target.

DESCRIPTION OF THE PREFERRED EMBODIMENTS

Nomenclature

Figure 1:
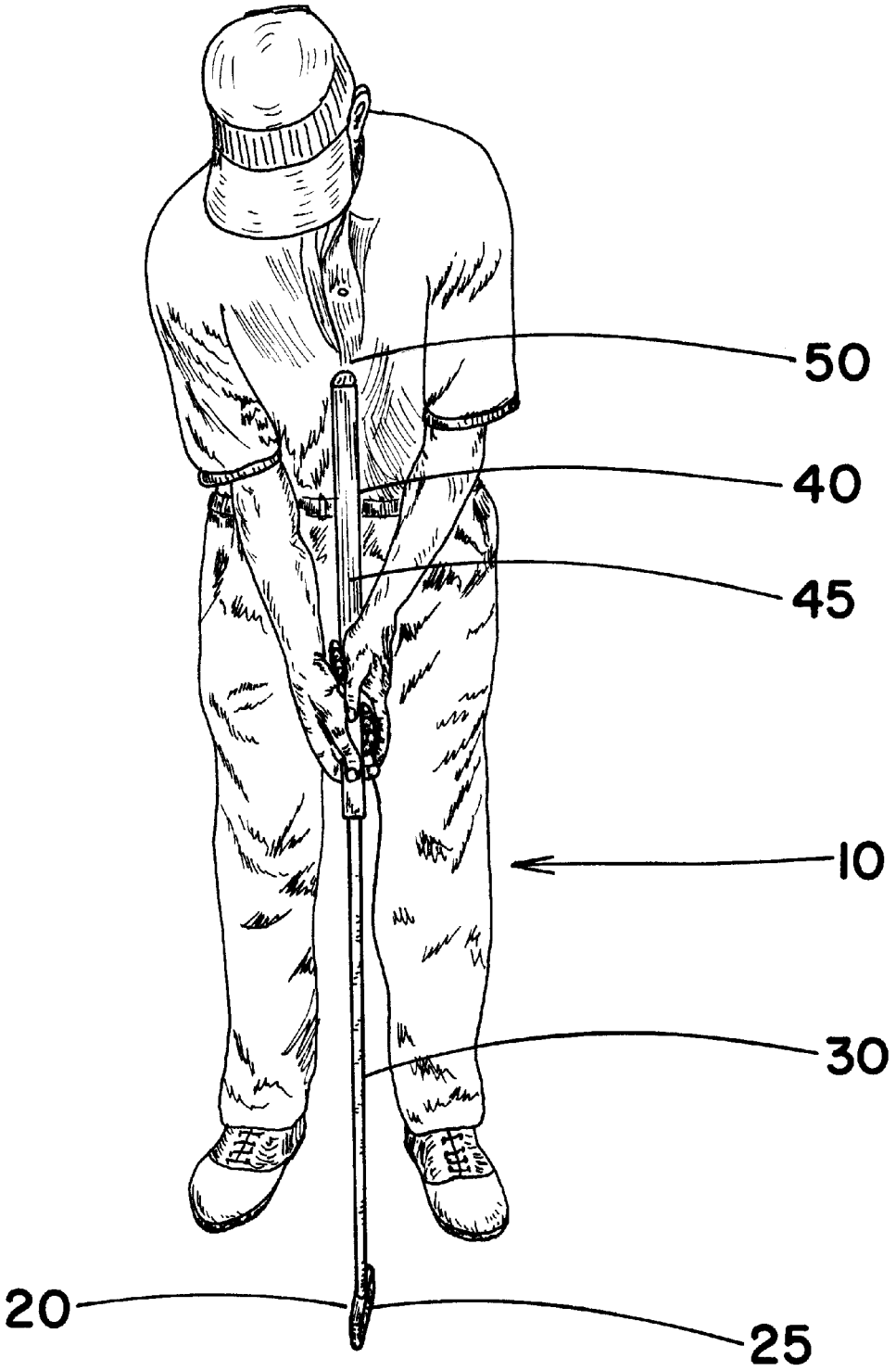
FIG. 1 is a front view of the player holding the golf club putter against his sternum.
Figure 2:
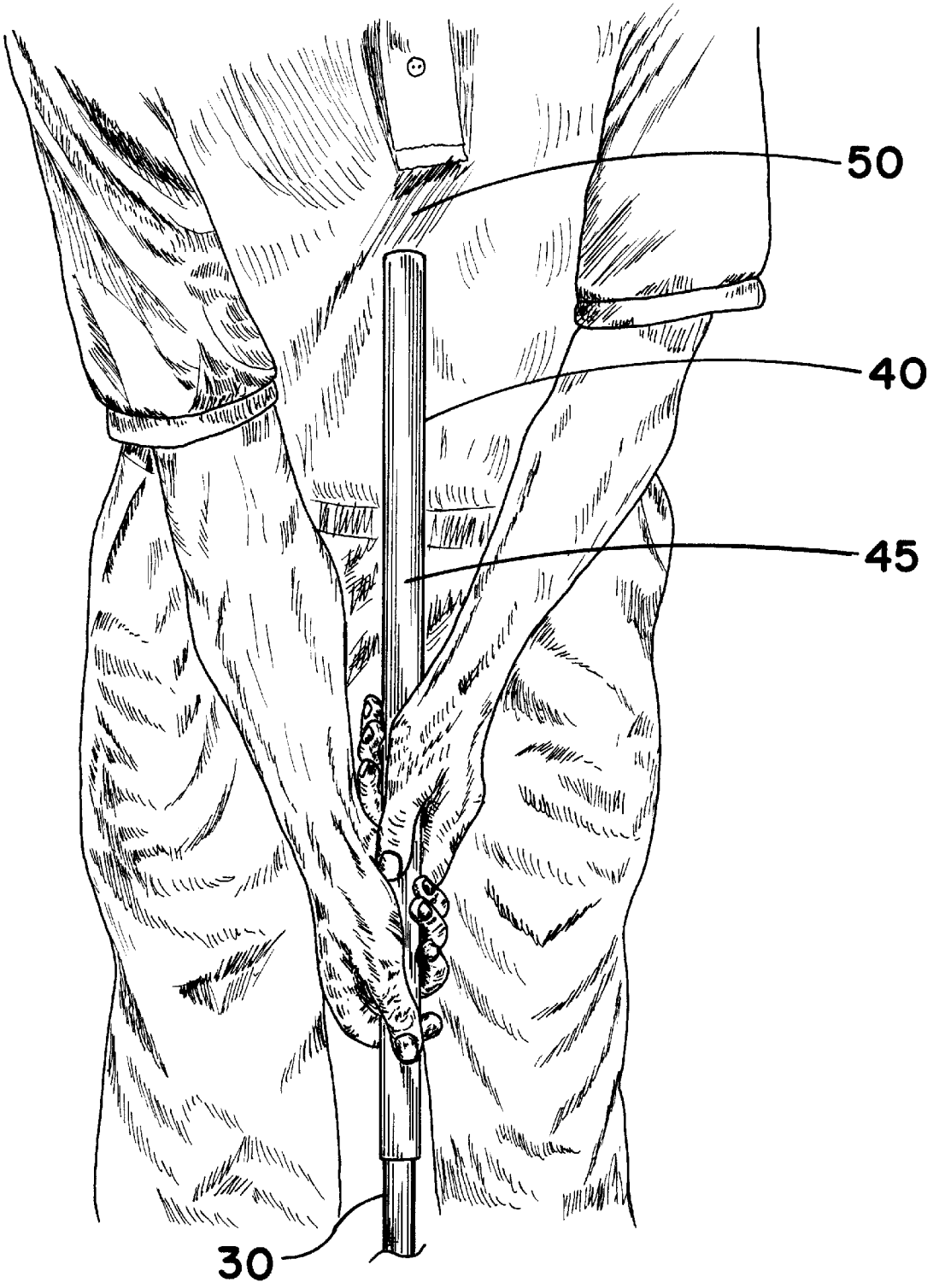
FIG. 2 is a close up front view of the player holding the golf club putter against his sternum.
Figure 3:
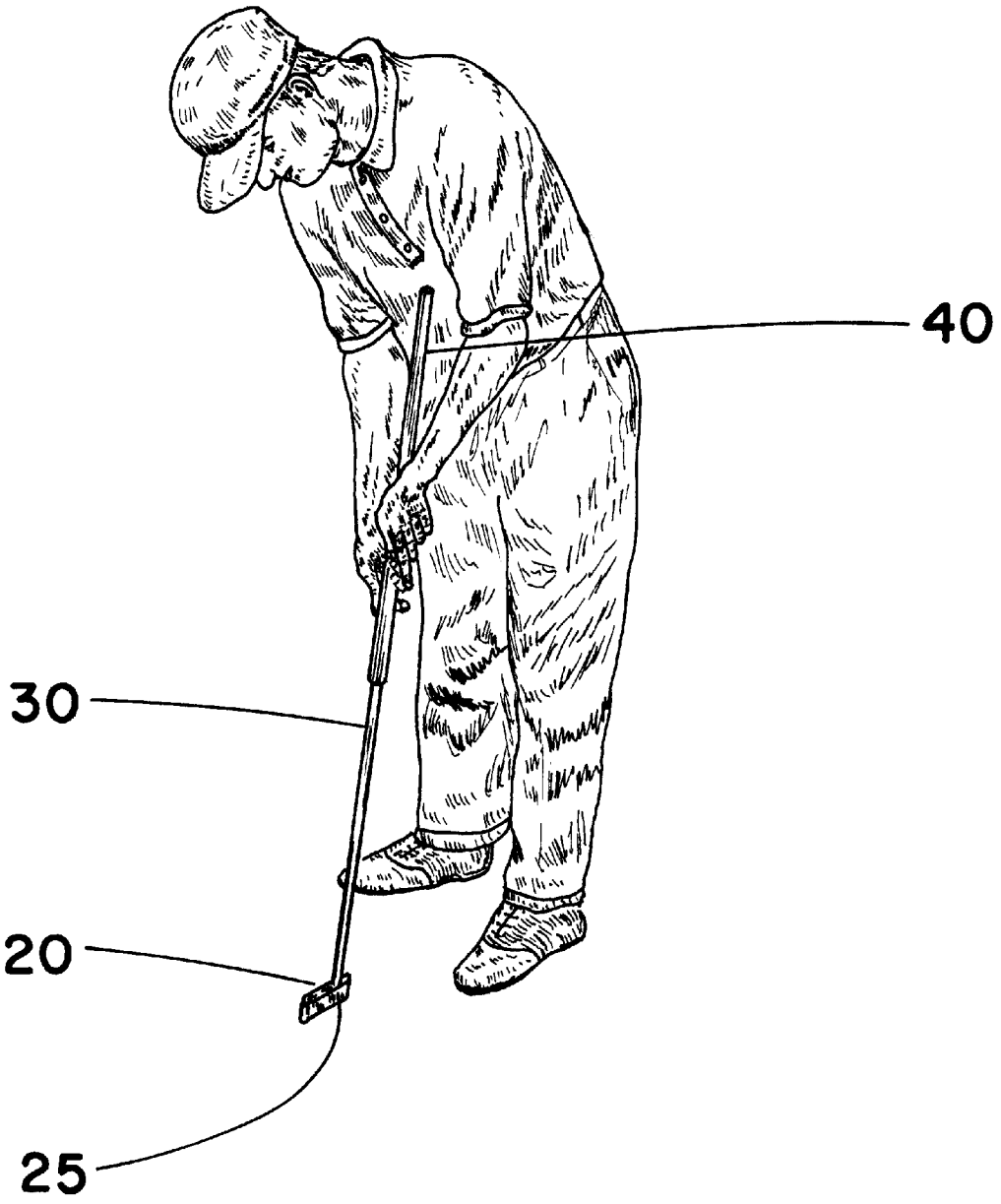
FIG. 3 is a perspective view of the player and club of FIG. 1.
Figure 4:
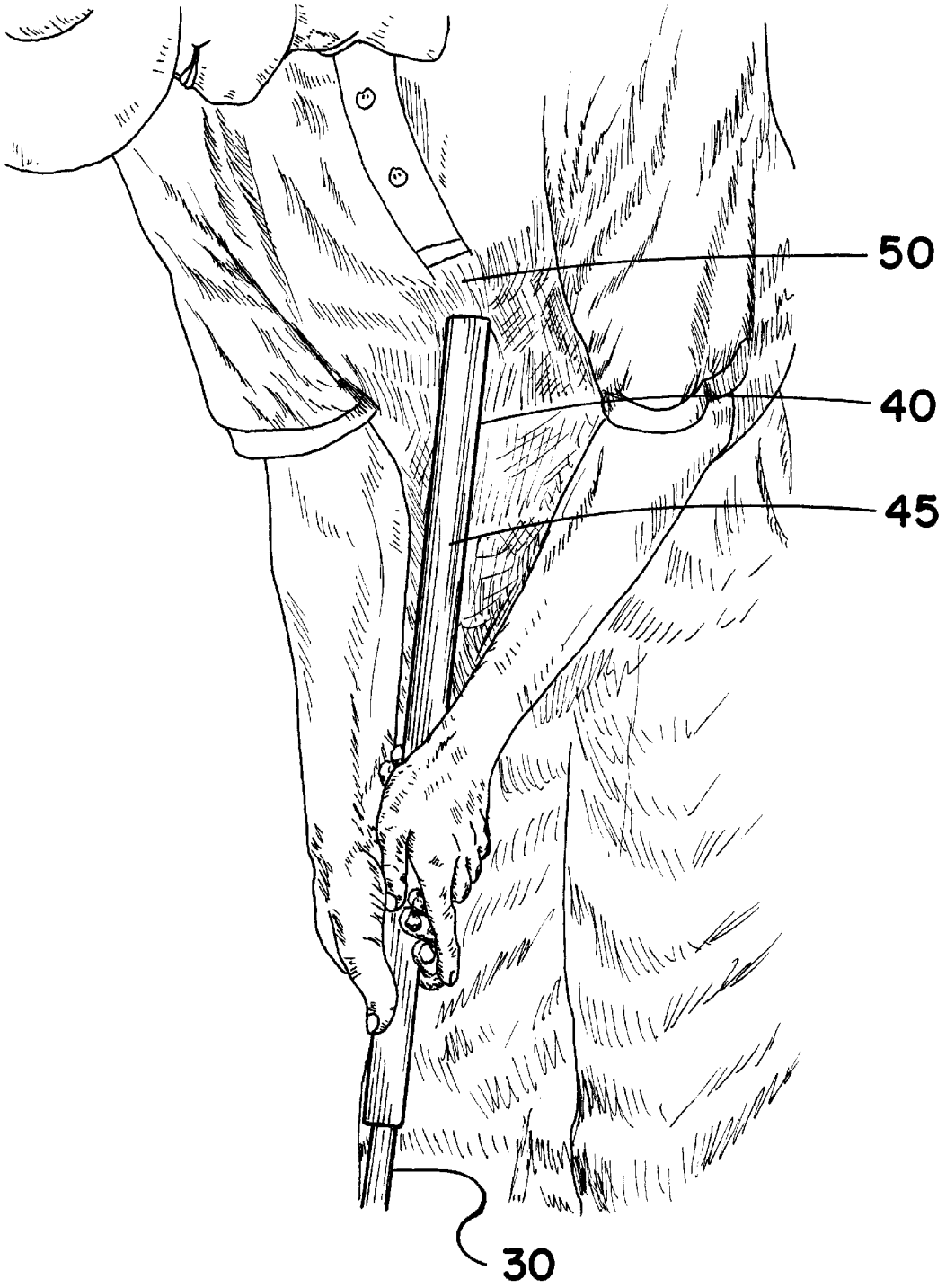
FIG. 4 is a close up perspective view of the player and club of FIG. 3.
Figure 5:
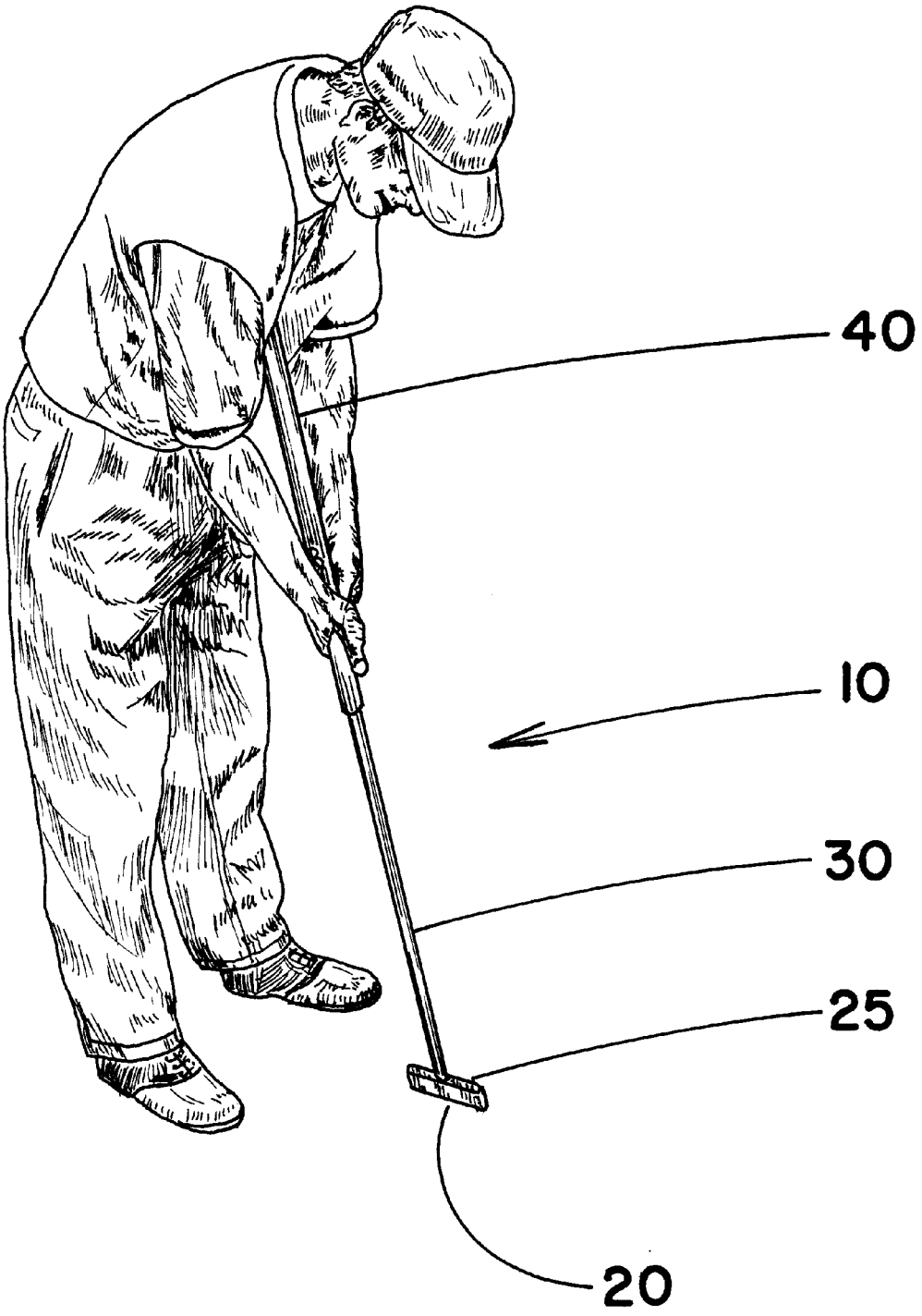
FIG. 5 is another perspective view of the player and club of FIG. 1.
Figure 6:
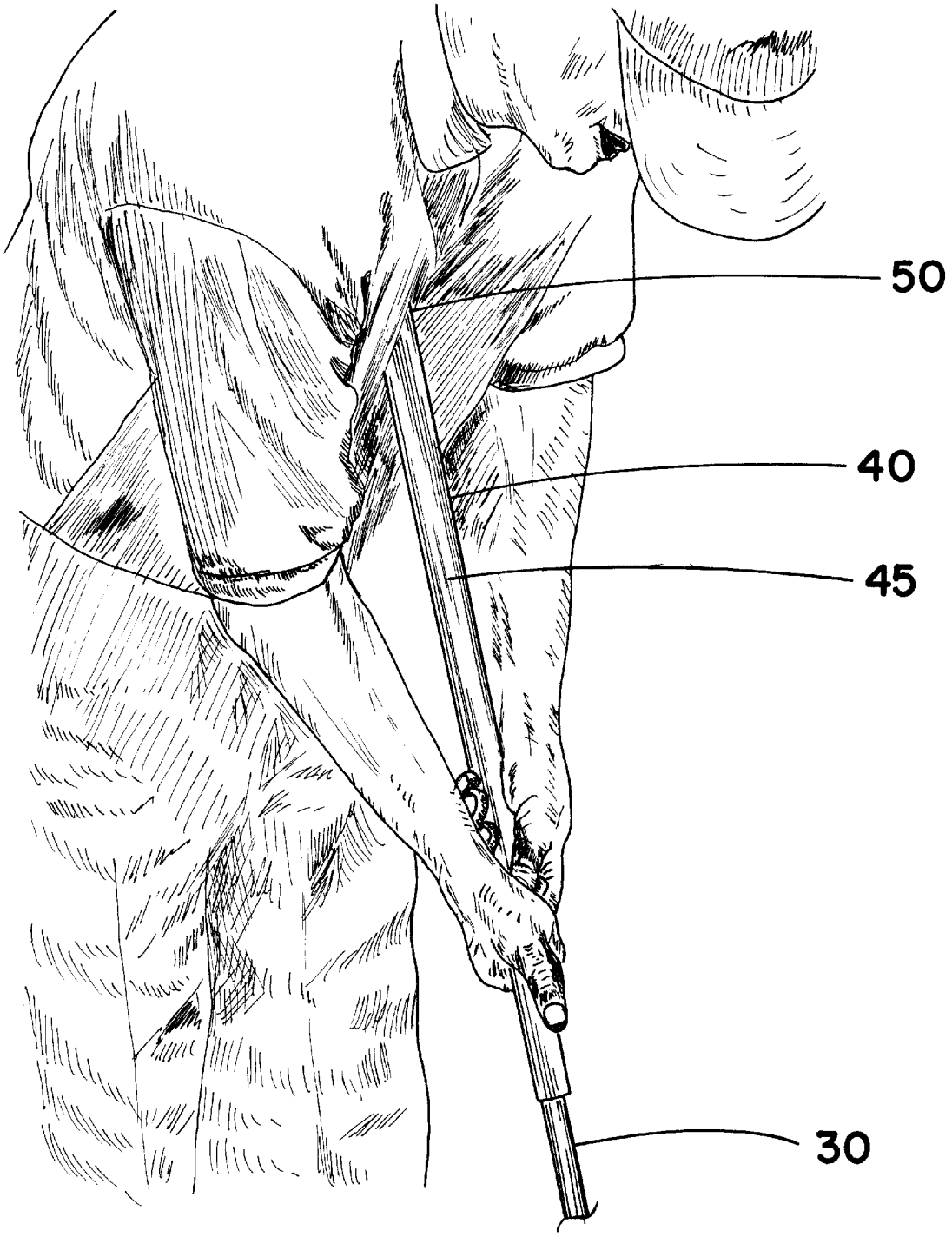
FIG. 6 is a close up perspective view of the player and club of FIG. 5.
Figure 7:
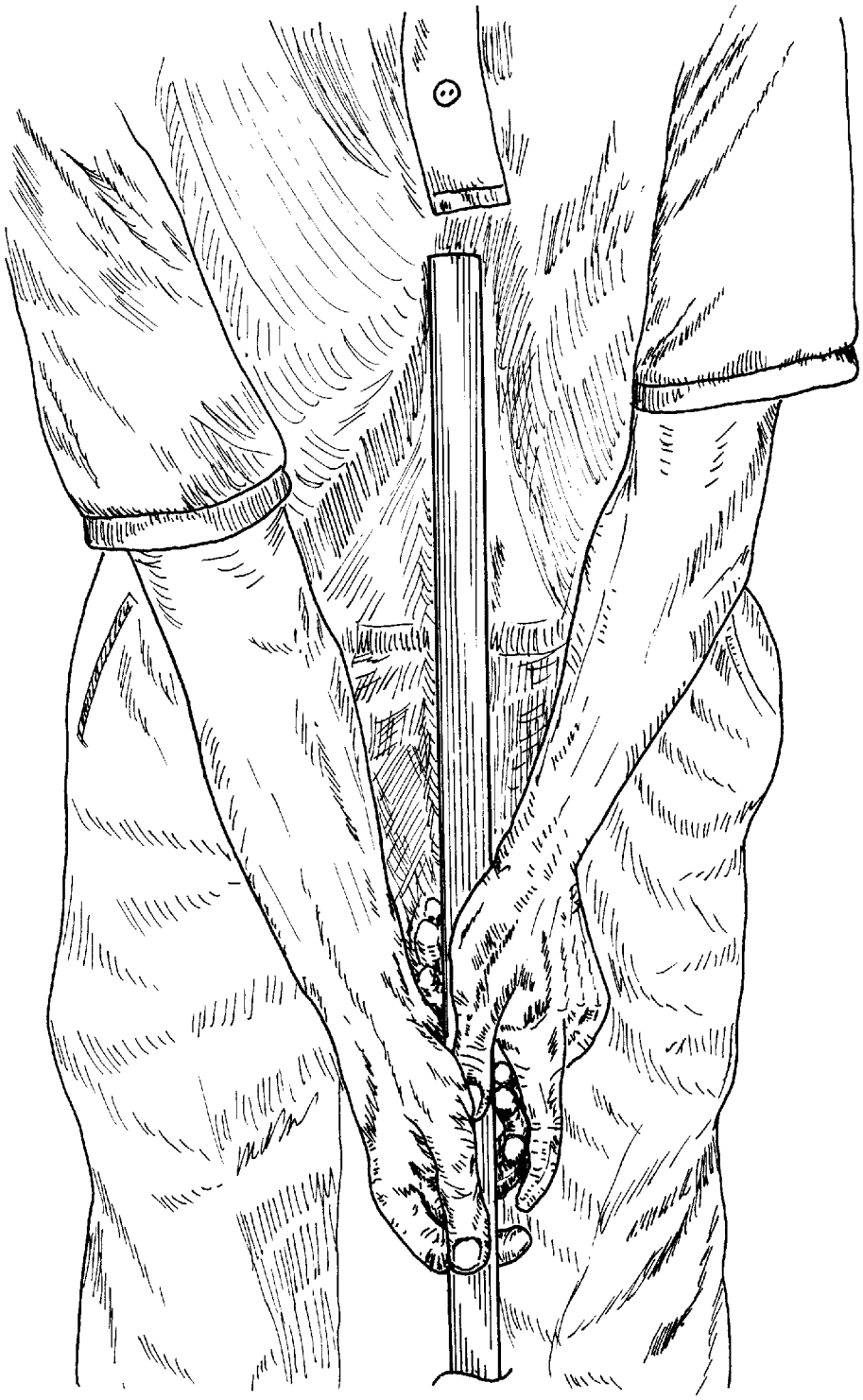
FIG. 7 is a close up front view of the player using one selected putting club grip.
Figure 8:
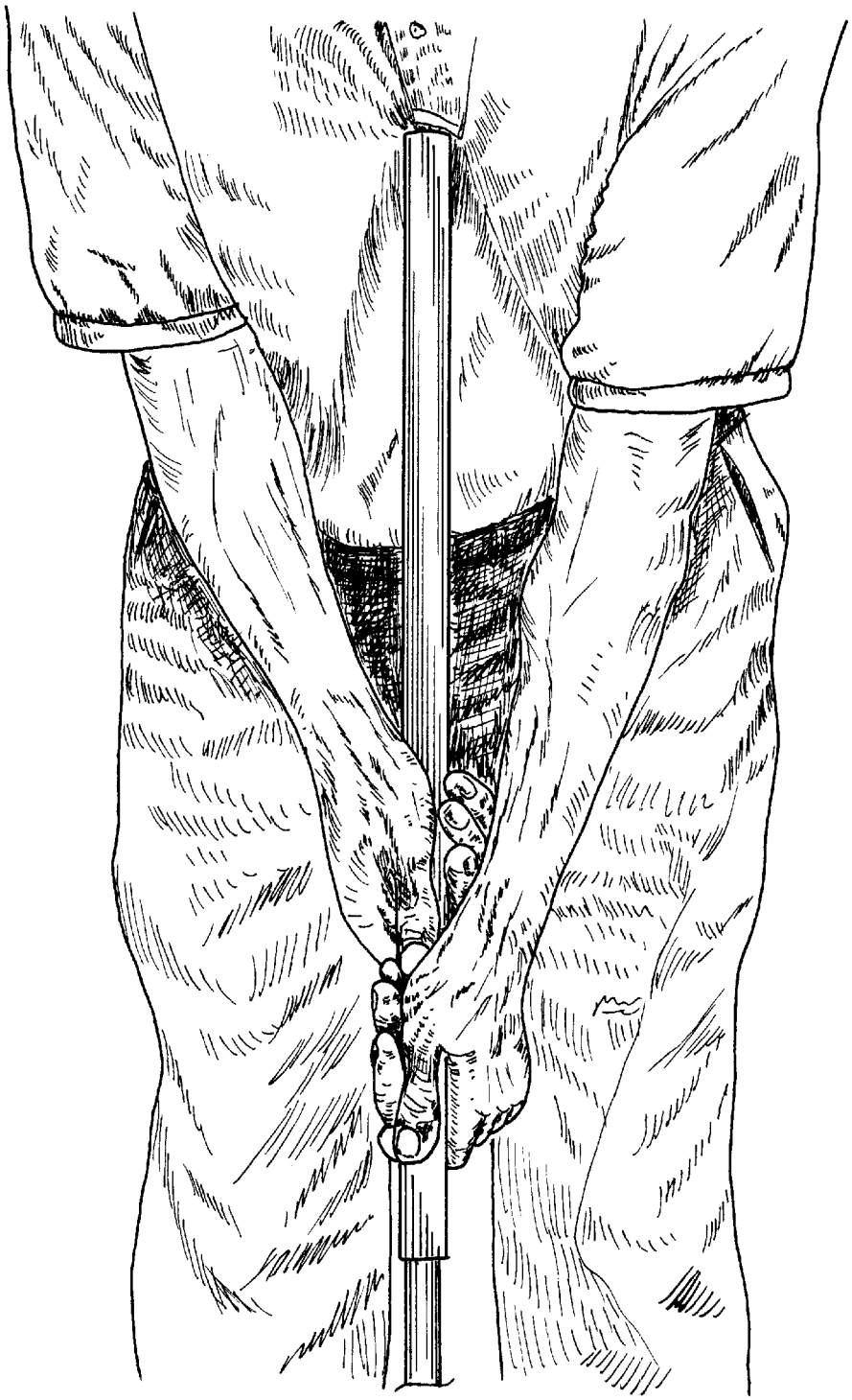
FIG. 8 is a close up front view of the player using another selected putting club grip.

10 Putting Club
20 Club Head Member
25 Face of Club Head Member
30 Club Shaft Member
40 Club Handle Member
45 Flat Surface of Club Handle Member
47 End of Club Handle Member
50 Sternum of Player Process The method of putting a golf ball of the present invention is exemplified in the attached FIGS. 1 through 13. The putting club 10 employed in the method has a club head member 20, a shaft member 30, and a handle member 40 positioned opposite the club head member 20, with the putting club 10 sized to enable a player standing on a playing surface to strike a golf ball adjacent to the player's feet with the face 25 of the club head member 20, while holding the end of the putting club handle member 40 in position against the player's sternum 50. The club head member 20 is preferably made of a dense metal or alloy such as silica bronze or stainless steel, and the shaft member 30 is preferably tubular stainless steel alloy or similar material. The shaft member 30 actually extends from the club head member 20 to the end 47 of the handle member 40 opposite the club head member 20. The handle member 40 fits snugly over the upper portion of the shaft member 30, providing a gripping surface for the player. The handle member 40 may be made of polymer composite, such as filled rubber; however, the handle member 40 is preferably made of leather and covers the top twenty four inches of the shaft member 30. Preferably, the handle member 40 is provided with a flat surface 45 that is oriented perpendicular to the face 25 of the club head member 20.

Since the method of putting of the present invention can be used by adults and children alike, the putting club 10 employed can vary in length. A smaller child would require a relatively short putting club 10 while a tall adult would use a much longer putting club 10. The proper length of the putting club 10 is determined by having a player stand adjacent to a golf ball with the player's head positioned such that the player's eyes are directly over the golf ball. The proper length of the putting club 10 is the distance from the low point of the golf ball to the player's sternum 50.

The player grasps the putting club handle member 40 with both hands and holds the end 47 of the putting club handle member 40 against the player's sternum 50, as shown in FIG. 1. The flat surface 45 of the club handle member 40 perpendicular to the club head face 25 furnishes a stable surface for the player's hands, enabling the player to firmly control the orientation of the club head member 20. The particular grip that the player uses to grasp the club handle member 40 is at the discretion of the player. Grips such as the reverse overlap grip (FIG. 2), the standard overlap grip (FIG. 7), or the cross hand grip (FIG. 8) may be employed with equal success. These hand grips are well known to golf players and need not be further described. The important point is to securely hold the end of the putting club member 40 against the player's sternum 50.

Figure 9:
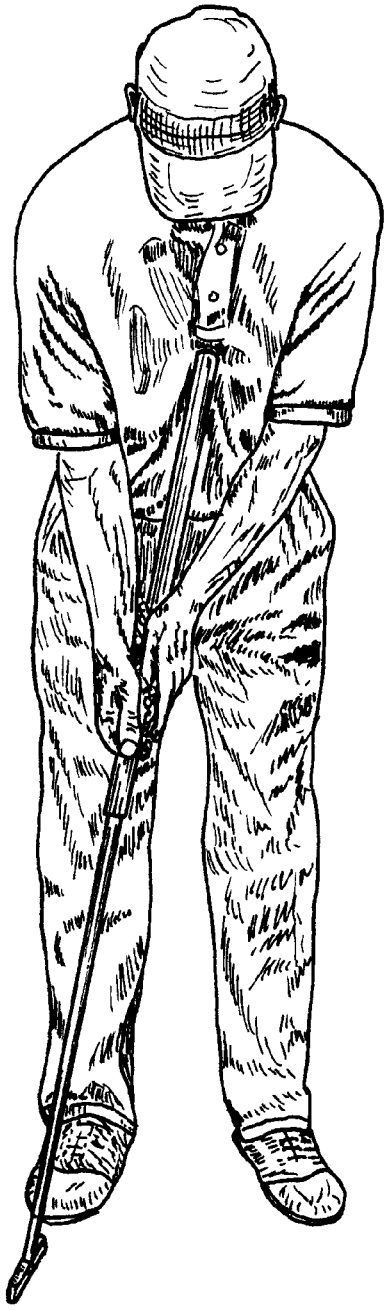
FIG. 9 is a front view of the player at the beginning of the backstroke.
Figure 10:
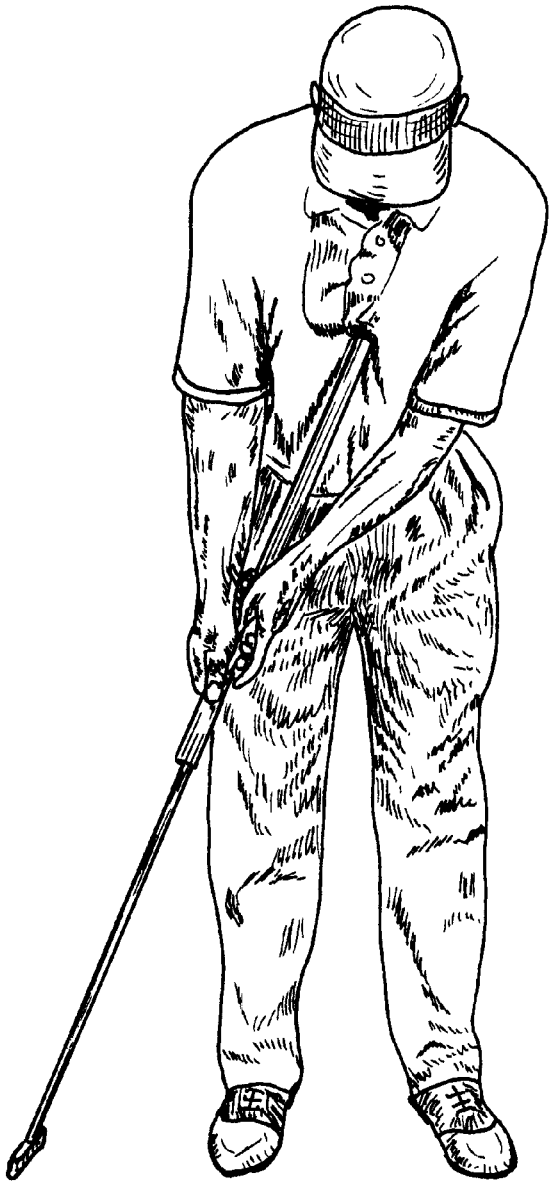
FIG. 10 is a front view of the player at the end of the backstroke.
Figure 11:
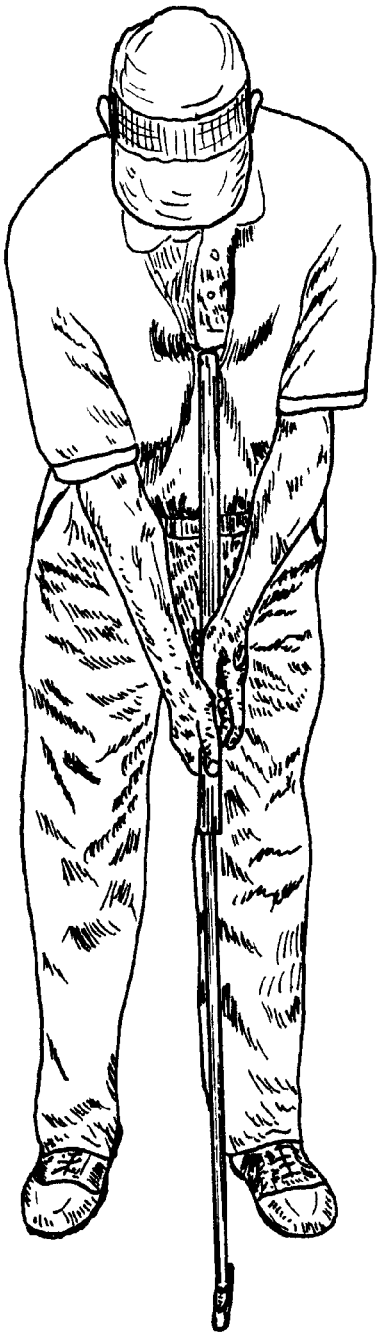
FIG. 11 is a front view of the player striking the ball on the forward stroke.
Figure 12:
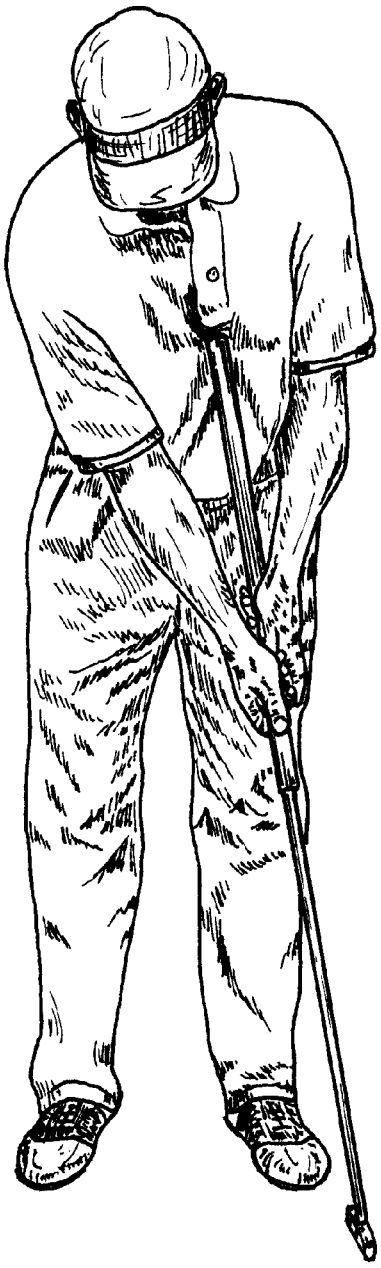
FIG. 12 is a front view of the player following through on the forward stroke.
Figure 13:
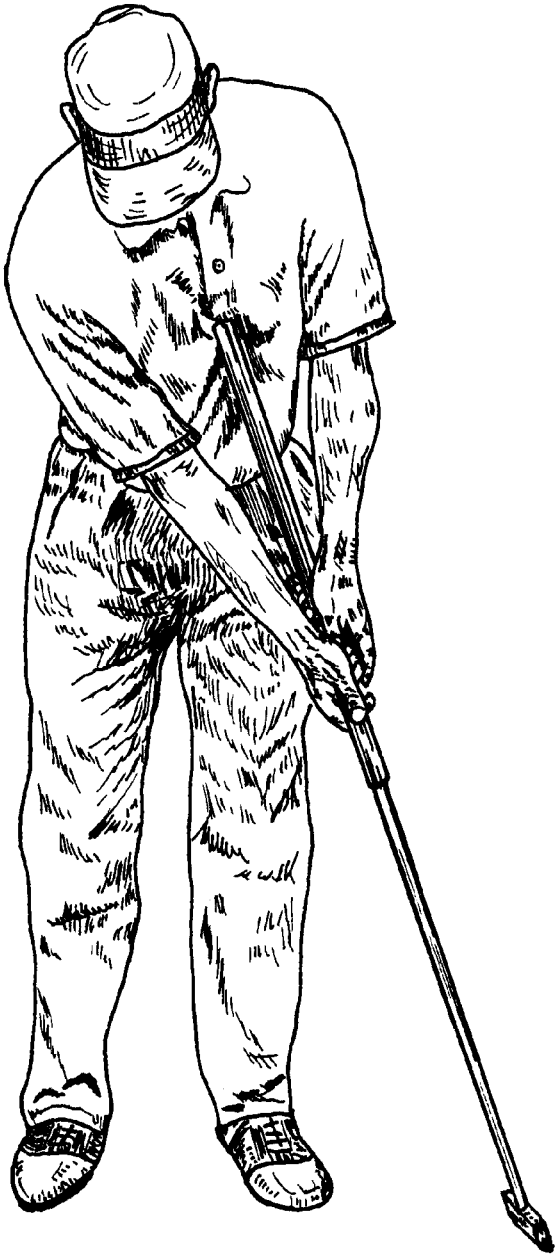
FIG. 13 is a front view of the player completing the follow through of the forward stroke.
Figure 14:
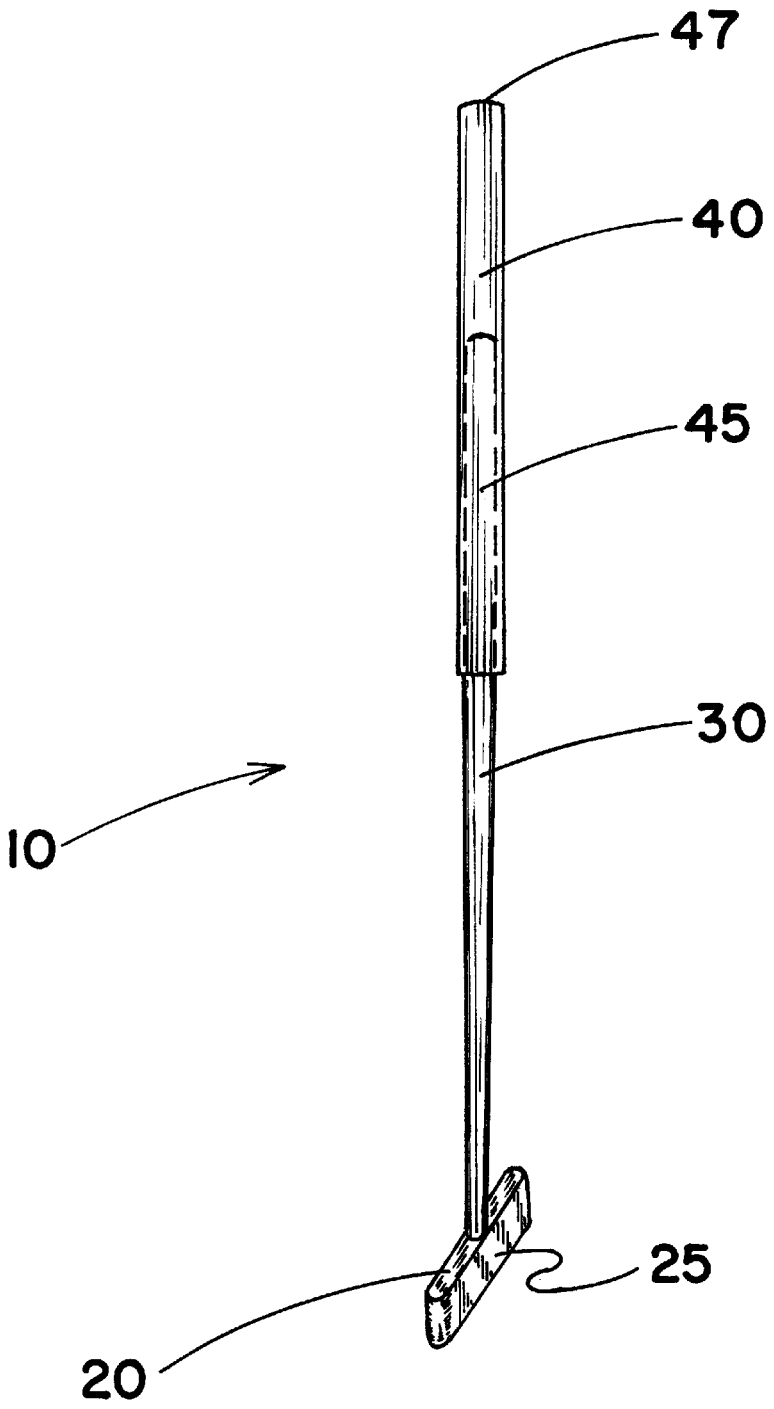
FIG. 14 is a perspective view of the golf club putter used in the present invention.

The complete putting stroke of the present invention is shown in FIGS. 9 through 13. In addition to holding the end 47 of club handle member 40 securely against the sternum 50 during the putting stroke, the player holds his wrists in a constant orientation relative to the putter club handle member 40 at all times during the putting stroke. The wrists cannot be allowed to "break" at any point in the putting stroke. The player utilizes shoulder pivoting only in the putting stroke. In FIGS. 9 and 10, the player pivots the player's upper body in one direction with the end 47 of the putting club handle member 40 positioned against the player's sternum 50, while holding the player's wrists in a constant orientation relative to the putting club handle member 40, to move the club head member 20 away from the golf ball positioned adjacent to the player's feet. The player next pivots the player's upper body in an opposite direction with the end 47 of the putting club handle member 40 positioned against the player's sternum 50, while holding the player's wrists in a constant orientation relative to the putting club handle member 40 to move the club head member 20 toward the golf ball positioned adjacent to the player's feet, thereby striking the golf ball with the face 25 of the putting club head member 20 in a controlled manner to propel the ball toward a target. This forward stroke is shown in FIGS. 11 through 13. The putting method of the present invention forces a true pendulum golf stroke with proper shoulder movement only.

This putting method provides the player with exceptional control and consistent results in the putting of a golf ball on a green surface. The putting method can be used by either right handed or left handed players with equal results. A putting club 10 with a symmetrical club head member 20, having two parallel opposed club head faces 25, is suitable for use by either right handed or left handed players. Further, the putting club 10 is designed to meet U.S. Golf Association specifications.

While the invention has been particularly shown and described with reference to a preferred embodiment thereof, it will be understood by those skilled in the art that various changes in form and details may be made therein without departing from the spirit and scope of the invention.

We claim:

1. A method of putting a golf ball comprising the steps;

(a) selecting a putting club having a club head member, a shaft member, and a handle member positioned opposite said club head member, the handle member covering at least a top twenty-four inches of the shaft member, said putting club sized to enable a player standing on a playing surface to strike a golf ball adjacent to the player's feet with said club head member, while holding an end of said putting club handle member in position against the player's sternum;

(b) grasping said putting club handle member with both hands with both forearms of the player at an acute angle to said putting club handle member, and holding said end of said putting club handle member against the player's sternum;

(c) pivoting the player's upper body in one direction with said end of said putting club handle member positioned against the player's sternum, while holding the player's wrists in a constant orientation relative to said putting club handle member to move said club head member away from the golf ball positioned adjacent to the player's feet; and (d) pivoting the player's upper body in an opposite direction with said end of said putting club handle member positioned against the player's sternum, while holding the player's wrists in a constant orientation relative to said putting club handle member to move said club head member toward the golf ball positioned adjacent to the player's feet, thereby striking the golf ball with said putting club head member in a controlled manner to propel the ball toward a target.

2. The method of putting a golf ball according to claim 1, wherein said selected putting club is sized to extend from a low point of a golf ball on a playing surface adjacent to a player's feet to a player's sternum, with the player's head positioned with the player's eyes directly over the golf ball.

3. The method of putting a golf ball according to claim 1, wherein the player's hands grasp said handle member in a standard overlap grip.

4. The method of putting a golf ball according to claim 1, wherein the player's hands grasp said handle member in a reverse overlap grip.

5. The method of putting a golf ball according to claim 1, wherein the player's hands grasp said handle member in a cross hand grip.

6. A method of putting a golf ball comprising the steps;

(a) selecting a putting club having a club head member with a club head face, a shaft member, and a handle member positioned opposite said club head member, the handle member covering at least a top twenty-four inches of the shaft member, said handle member having a flat surface oriented perpendicular to said club head face, said putting club sized to enable a player standing on a playing surface to strike a golf ball adjacent to the player's feet with said club head face of said club head member, while holding an end of said putting club handle member in position against the player's sternum;

(b) grasping said putting club handle member with both hands contacting said handle member flat surface with both forearms of the player at an acute angle to said putting club handle member, and holding said end of said putting club handle member against the player's sternum;

(c) pivoting the player's upper body in one direction with said end of said putting club handle member positioned against the player's sternum, while holding the player's wrists in a constant orientation relative to said putting club handle member to move said club head member away from the golf ball positioned adjacent to the player's feet; and (d) pivoting the player's upper body in an opposite direction with said end of said putting club handle member positioned against the player's sternum, while holding the player's wrists in a constant orientation relative to said putting club handle member to move said club head member toward the golf ball positioned adjacent to the player's feet, thereby striking the golf ball with said club head face of said putting club head member in a controlled manner to propel the ball toward a target.

7. The method of putting a golf ball according to claim 6, wherein said selected putting club is sized to extend from a low point of a golf ball on a playing surface adjacent to a player's feet to a player's sternum, with the player's head positioned with the player's eyes directly over the golf ball.

8. The method of putting a golf ball according to claim 6, wherein the player's hands grasp said handle member in a standard overlap grip.

9. The method of putting a golf ball according to claim 6, wherein the player's hands grasp said handle member in a reverse overlap grip.

10. The method of putting a golf ball according to claim 6, wherein the player's hands grasp said handle member in a cross hand grip.

* * * * *